US007335146B2

(12) United States Patent
Gerstung

(10) Patent No.: US 7,335,146 B2
(45) Date of Patent: Feb. 26, 2008

(54) CUSHIONED EXERCISE PLATFORM

(76) Inventor: Siegfried H. H. Gerstung, 1400 Coppermine Ter., Baltimore, MD (US) 21209-2012

( * ) Notice: Subject to any disclaimer, the term of this patent is extended or adjusted under 35 U.S.C. 154(b) by 0 days.

(21) Appl. No.: 11/509,016

(22) Filed: Aug. 24, 2006

(65) Prior Publication Data

US 2006/0287171 A1 Dec. 21, 2006

Related U.S. Application Data

(63) Continuation of application No. PCT/US2005/005766, filed on Feb. 24, 2005.

(60) Provisional application No. 60/546,975, filed on Feb. 24, 2004.

(51) Int. Cl.
*A63B 26/00* (2006.01)

(52) U.S. Cl. ..... 482/142; 482/77; 482/74

(58) Field of Classification Search ..... 482/23, 482/14, 15, 30, 25, 146–147, 34, 77, 74; D21/662

See application file for complete search history.

(56) References Cited

U.S. PATENT DOCUMENTS 4,146,222 A 3/1979 Hribar
4,405,129 A 9/1983 Stuckey
5,116,045 A * 5/1992 Jahoda ..... 472/92
5,277,675 A * 1/1994 Shifferaw ..... 482/30
5,658,226 A 8/1997 Mentz
6,132,338 A * 10/2000 Shifferaw ..... 482/30
6,261,206 B1 * 7/2001 Kranz et al. ..... 482/23
6,419,611 B1 7/2002 Levine

* cited by examiner

*Primary Examiner*—Lori Amerson
(74) *Attorney, Agent, or Firm*—J. Andrew McKinney, Jr.; Jones, Tullar & Cooper, PC

(57) ABSTRACT

A portable resilient action exercise platform 10 permits the user to jog in place when indoors and provides an increasing resistance to deformation as the amount of deformation of the platform increases. A support assembly including a spaced array of flexible user selectable and replaceable resilient supporting blocks 12 provides a variable amount of support for the exercise platform so that the rebounding action of exercise platform 10 can be varied. Platform 10 preferably includes a spaced array of flexible user-replaceable resilient supporting blocks 12 to absorb the impact of the user's footfalls or movements, and is preferably constructed of strong, flexible structural polymer supported, preferably, by eight or nine resilient flexible user-replaceable foam supporting blocks 12, each preferably comprising a closed cell foam support of selected durometer.

20 Claims, 4 Drawing Sheets

CUSHIONED EXERCISE PLATFORM

CROSS-REFERENCE TO RELATED APPLICATIONS

This application claims priority to provisional patent application No. 60/546,975, filed Feb. 24, 2004, the entire disclosure of which is incorporated herein by reference. This application is a continuation, under 35 U.S.C. 120 and 365(c), of copending International Application No. PCT/US05/05766, which was filed on Feb. 24, 2005 and designates the United States. PCT/US05/05766 published as WO 2005/082464 on Sep. 9, 2005 in the English language.

BACKGROUND OF THE INVENTION

1. Field of the Invention

The present invention relates to exercise devices and more particularly to an exercise platform permitting the user to jog in place when indoors. The exercise platform of present invention provides an increasing resistance to deformation as the amount of deformation of the platform increases, and a support assembly provides a variable amount of support for the exercise platform so that the rebounding action of the exercise platform can be varied.

2. Discussion of the Prior Art

In recent years, the general public has become more concerned with health issues. Increased pollution and recent awareness regarding heart disease now make aerobic exercise in a clean environment a necessity. Some common forms of aerobic exercise include running, jogging, walking, and choreographed movements referred to as "aerobics". Aerobic exercise enhances the heart and lungs and, with a proper diet, may reduce the risk of heart attack and stroke.

When running or jogging, it is common for exercisers to simply go outdoors and jog or run for a predetermined distance. In many locations, this form of exercise is really only practical during the warmer months of the year, and in clean, safe areas. It may be difficult for a user living in a city environment to find an area to comfortably run or jog for an extended interval, over long distances. Some health clubs and centers now provide indoor running tracks, but these facilities are usually expensive to use.

Users hoping to exercise year round without incurring the costs of joining a health club are using in-home running apparatus of two basic designs. The first is the moving web treadmill type that actually gives the user the sensation of striding forward, but requires a power source, has many moving parts, and has proven to be expensive and often unreliable.

The second in-home running apparatus is the "in place" jogging type apparatus which may have a resilient yielding surface simulating a running track. A resilient yielding surface may force the user to engage in greater up and down movement during exercise, and the up and down movement of the torso or center of gravity of the body results in greater energy expended during exercising. This, in turn, results in greater aerobic output within a shorter period of time.

An example of an "in place" type jogging apparatus incorporating a resilient yielding surface structure can be seen in U.S. Pat. No. 4,146,222. The '222 device discloses an "in place" jogging apparatus including a pair of separate, flexible and deformable fluid filled volumes which are confined in an enclosure and react reciprocally to each other as body weight is applied alternately to each volume. Production and design costs make such an "in place" type jogger quite expensive. In addition, the yielding of the surface may not be a natural one that could, for example, cause back problems in the user. Further, depending on the size and weight of the user, a device like that of the '222 patent could be susceptible to damage (i.e. bursting of the volumes). Finally, an "in place" type jogger is subject to natural wear and tear from long-term use and is not readily adaptable to permit a user to tailor the resilient character of the jogging surface. Other devices have provided bladders or containers filled with sand, or the like, but they are heavy and messy. In addition, none of these devices is portable, and so are not well suited for taking to a hotel room or the like when traveling.

Other surfaces have proven unsuitable for other reasons, for example, a user needs an exercise or jogging surface to be stable, so the user won't readily fall off when working out, and it must be quiet when in use, since apartment dwellers, in particular, need to avoid disturbing their neighbors in adjacent spaces. Finally, users want to avoid cluttering up their apartment or home with large, bulky equipment.

Other devices are known that provide support for indoor exercise. For example, trampolines, mini-tramps, springboards and other similar structures having a very high degree of rebounding action are known. These devices enable a user to practice maneuvers such as flips, jumps and turns with great ease due to their high degree of resiliency. However, trampolines and the like cannot effectively be used for exercising by jogging in place when away from home (e.g., when in a hotel room), due to their size and lack of portability. Furthermore, because trampolines rebound over a large displacement distance, they do not provide a firm enough surface to support the user during running or jogging exercise. As a result, the user cannot maintain the proper control necessary to perform the exercise correctly and safely.

There is a need, therefore, for an exercise device that overcomes the problems of the prior art.

OBJECTS AND SUMMARY OF THE INVENTION

Accordingly, it is a primary object of the present invention to overcome the above-mentioned difficulties by providing an inexpensive, quiet, portable, adjustable exercise surface for use in exercise such as jogging.

Another object of the present invention is to provide an easily stored and deployed resilient, stable exercise surface and method for use in exercise such as jogging.

It is another object of the present invention to provide an exercise platform assembly having a rebounding action that is easily and conveniently varied. This is achieved in the present invention by providing an adjustable support assembly under an exercise platform so that the exercise platform is able to flex as a force is applied thereto. The adjustable support assembly comprises a first level support structure and a second level support structure, both of which are removably inserted under the exercise platform. The first support structure is inserted under the exercise platform and is placed at four corners of the platform, resting in continuous contact with the ground. The second support structure is inserted under the exercise platform and, when not bearing a user's weight, is spaced above the ground. The first and second support structures are shaped such that an increasingly greater amount of the support structures support the exercise platform as the amount of weight borne by the exercise platform increases. As the amount of support structure supporting the exercise platform is varied, the rebounding action of the exercise platform is likewise varied.

The aforesaid objects are achieved individually and in combination, and it is not intended that the present invention be construed as requiring two or more of the objects to be combined.

In accordance with the present invention, a personal and portable resilient action or exercise platform assembly is readily placed on the floor by a user for jogging in place, running in place, jumping in place or performing choreographed movements in place.

The platform assembly includes a support structure comprising a spaced array of flexible user-replaceable resilient supporting blocks to absorb the impact of the user's footfalls or movements. The platform assembly includes a platform body constructed of strong, flexible structural polymer. The platform body is supported, preferably, by eight or nine resilient flexible user-replaceable foam supporting blocks, each preferably comprising a closed cell foam support of selected durometer, resilience or stiffness.

The support structure's foam blocks are interchangeable and stiffer blocks can be installed by those users wishing to exercise on a stiffer surface or heavier users who may choose to select more resilient blocks. Conversely, those users wishing to exercise on a more cushioned surface or lighter users may select softer or less resilient blocks. The user may also support a part of the platform with a first support structure including stiffer blocks while supporting another part of the platform with a second support structure including less resilient blocks.

In an illustrative embodiment, the platform of the present invention has a central slightly raised circular surface enclosed by four concave sides of substantially equal length and terminating in four square-shaped radially projecting corners to define stability enhancing "outriggers." The outriggers stabilize the platform and prevent tipping when a user steps or places weight on one edge when mounting or dismounting the platform. Each outrigger carries at least one flexible user-replaceable resilient supporting block in a pocket sized to receive and retain the block. The remaining four or five user-replaceable resilient supporting blocks can be placed by the user in selected square pockets defined by the intersecting ribs molded into the platform body.

The platform body is preferably molded from plastic or structural polymer foam that is blown into a mold defining an intersecting rib-reinforced, substantially planar structural surface having radiused outer peripheral edges. The resulting platform is light weight and provides an exercise surface with a circular area having a diameter of approximately 28 inches. The platform is convenient to transport and stack. The resilient foam blocks assure that the platform's use, even in an apartment, hotel room, or other multi-unit facility, will be quiet and non-disturbing to others. The resilient foam blocks and platform effectively absorb and dampen the sound of footfalls when exercising.

In use, the platform can be used for jogging in place on the platform surface, jumping in place on the platform surface, stepping or hopping onto and off of the platform surface, performing a choreographic routine on the platform surface or performing any other physical or exercise related activity that is enhanced by the "stiff" cushioning provided by the platform of the present invention.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
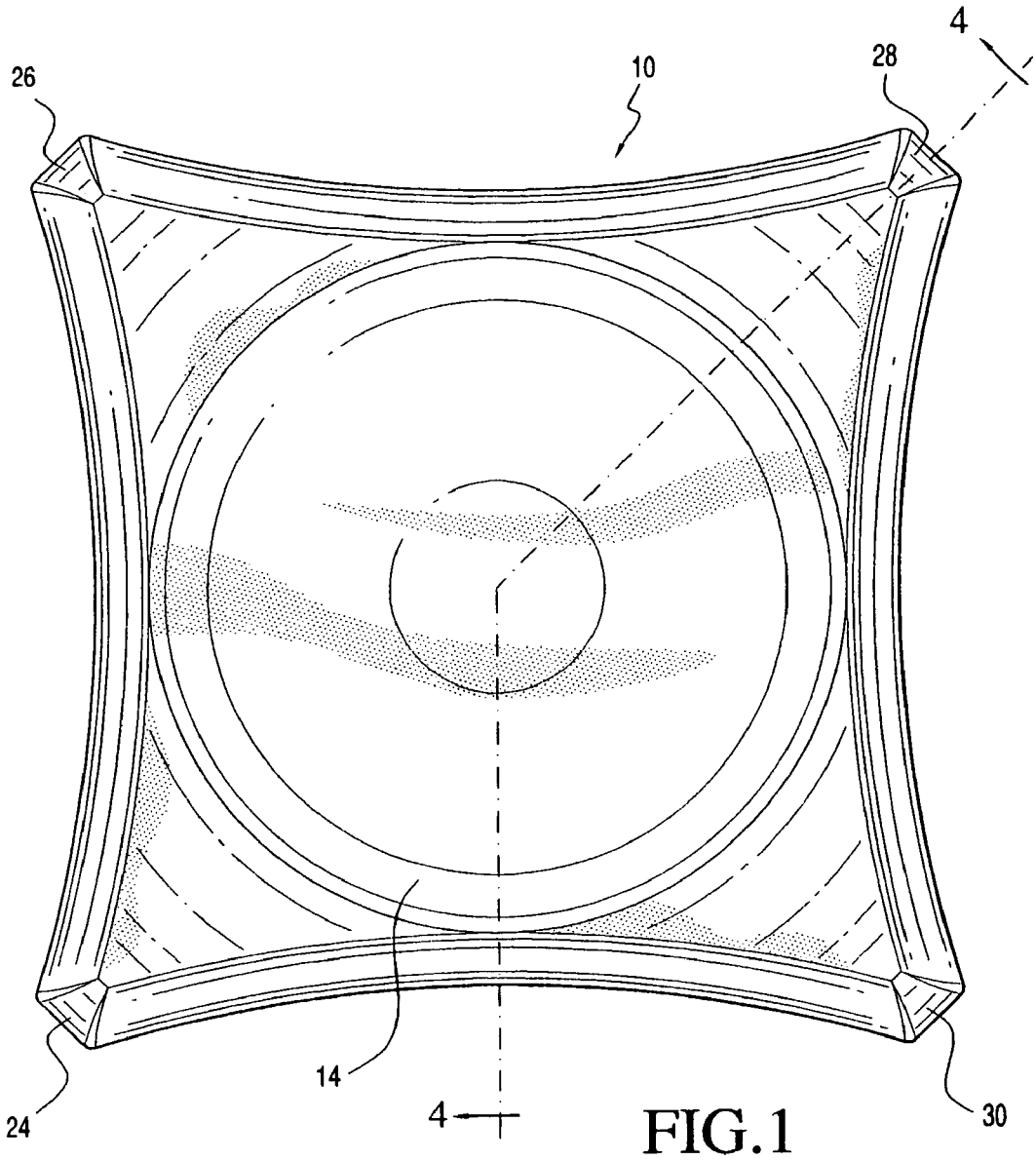
FIG. 1 is a top view, in elevation, of the upper surface of an exercise platform, in accordance with the present invention.

An exemplary embodiment of an exercise platform in accordance with the present invention is discussed below with reference to FIGS. 1-7. FIG. 1 illustrates an exercise platform, generally indicated at 10, that is portable, stable, resilient and firm. In the illustrated embodiment, exercise platform 10 includes a plurality of supporting foam blocks 12. The platform 10 includes a unitary, integral one-piece platform body made from a polymer material that tends to return to its original position once deflected, bending or bowing downwardly under a user's weight to impart a force on the support blocks 12 tending to compress foam blocks 12 when in use.

Figure 7:
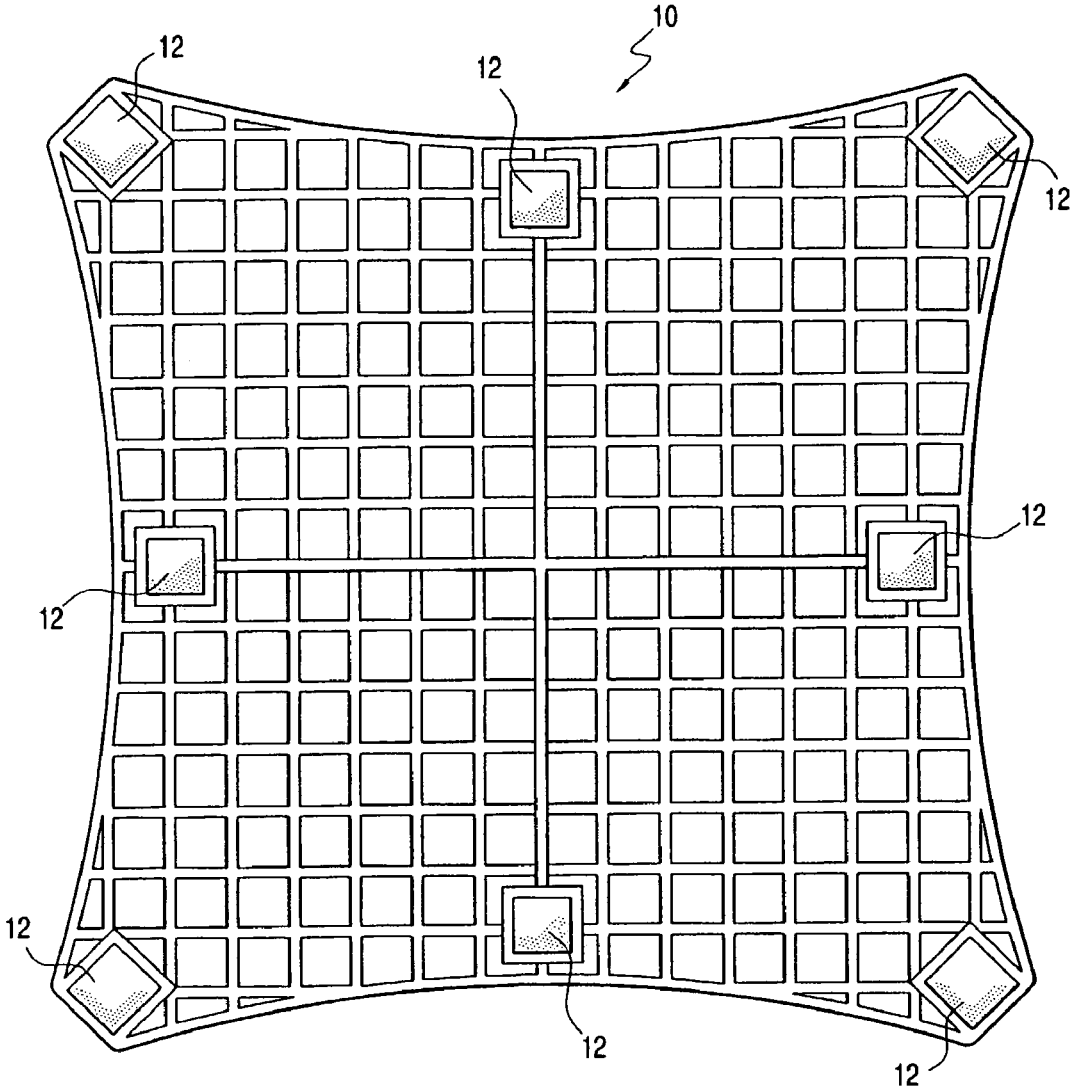
FIG. 7 is a bottom view, in elevation, of the exercise platform of FIG. 6 showing the intersecting ribs and the pockets defined therebetween and showing selected locations for the resilient flexible user-replaceable foam supporting blocks, in accordance with the present invention.
Figure 6:
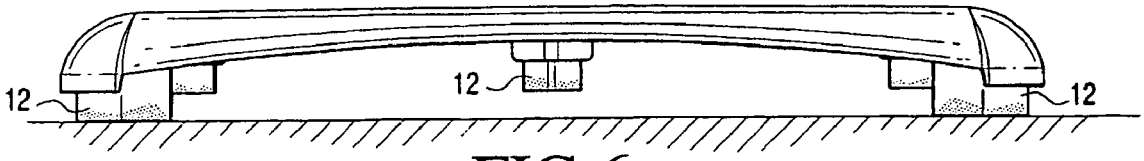
FIG. 6 is a side view, in elevation, of an exercise platform of the present invention showing selected locations for the resilient flexible user-replaceable foam supporting blocks.

Portable resilient action exercise platform 10 is readily placed on the floor by a user and can then be used to jog or run in place. As best seen in FIGS. 6 and 7, platform 10 includes a spaced array of flexible, resilient user-replaceable supporting blocks 12 to absorb the impact of the user's footfalls or movements.

Platform 10 is preferably constructed of strong, flexible structural polymer, and is supported, preferably, by eight or nine resilient flexible user-replaceable polymer foam supporting blocks 12, each preferably comprising a closed cell foam support of selected durometer, resilience or stiffness. Supporting foam blocks 12 are user-interchangeable and stiffer blocks are for use by those users wishing to exercise on a stiffer surface; heavier users may also select more resilient blocks. Conversely, those users wishing to exercise on a more cushioned surface or lighter users may select softer or less resilient blocks 12. The user may also select blocks of more than one stiffness to support a part of platform 10 with stiffer blocks while supporting another part of the platform with less resilient blocks.

Figure 3:
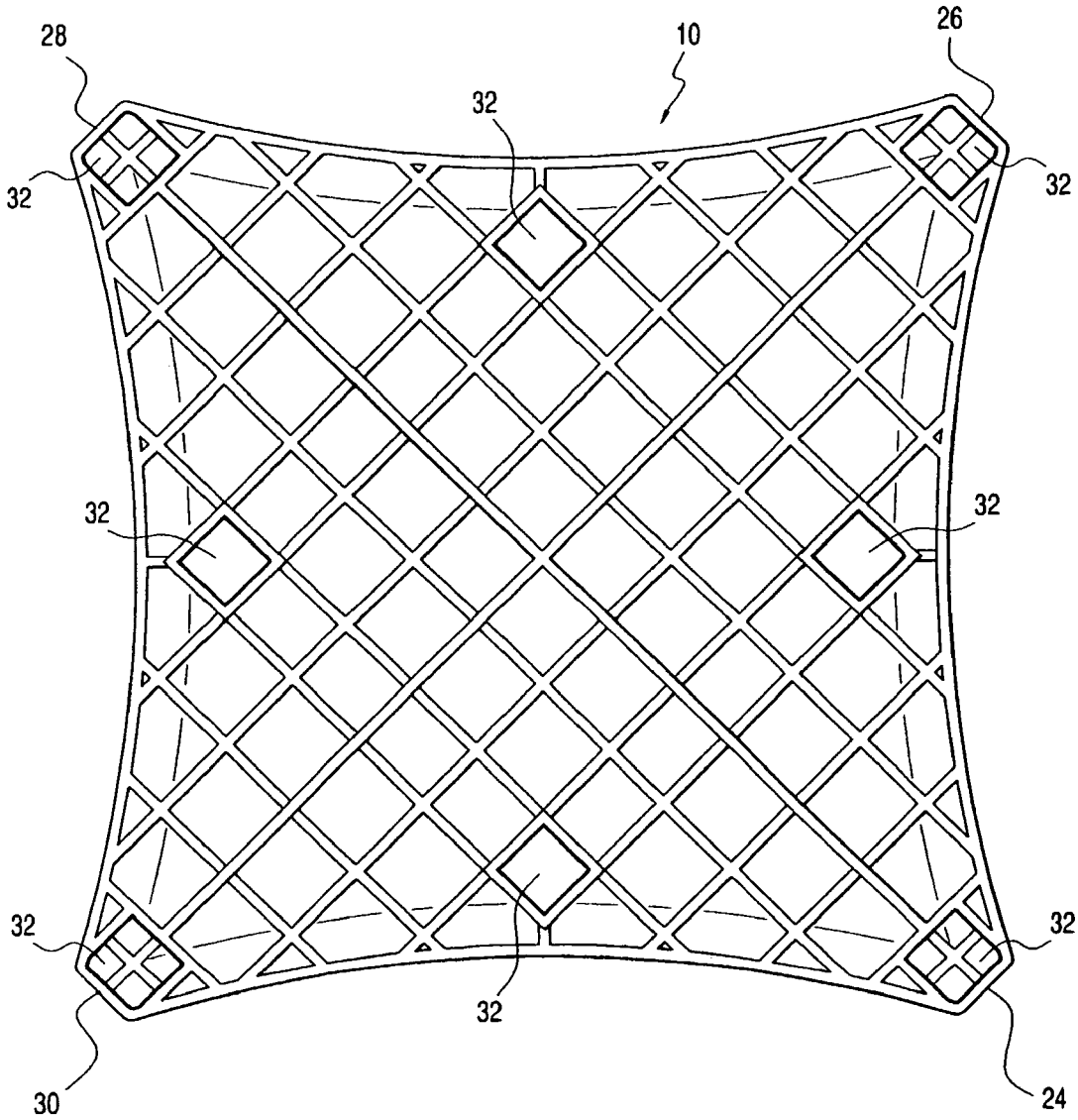
FIG. 3 is a bottom view, in elevation, of the exercise platform of FIG. 1 showing the intersecting ribs and the pockets defined therebetween, in accordance with the present invention.
Figure 5:
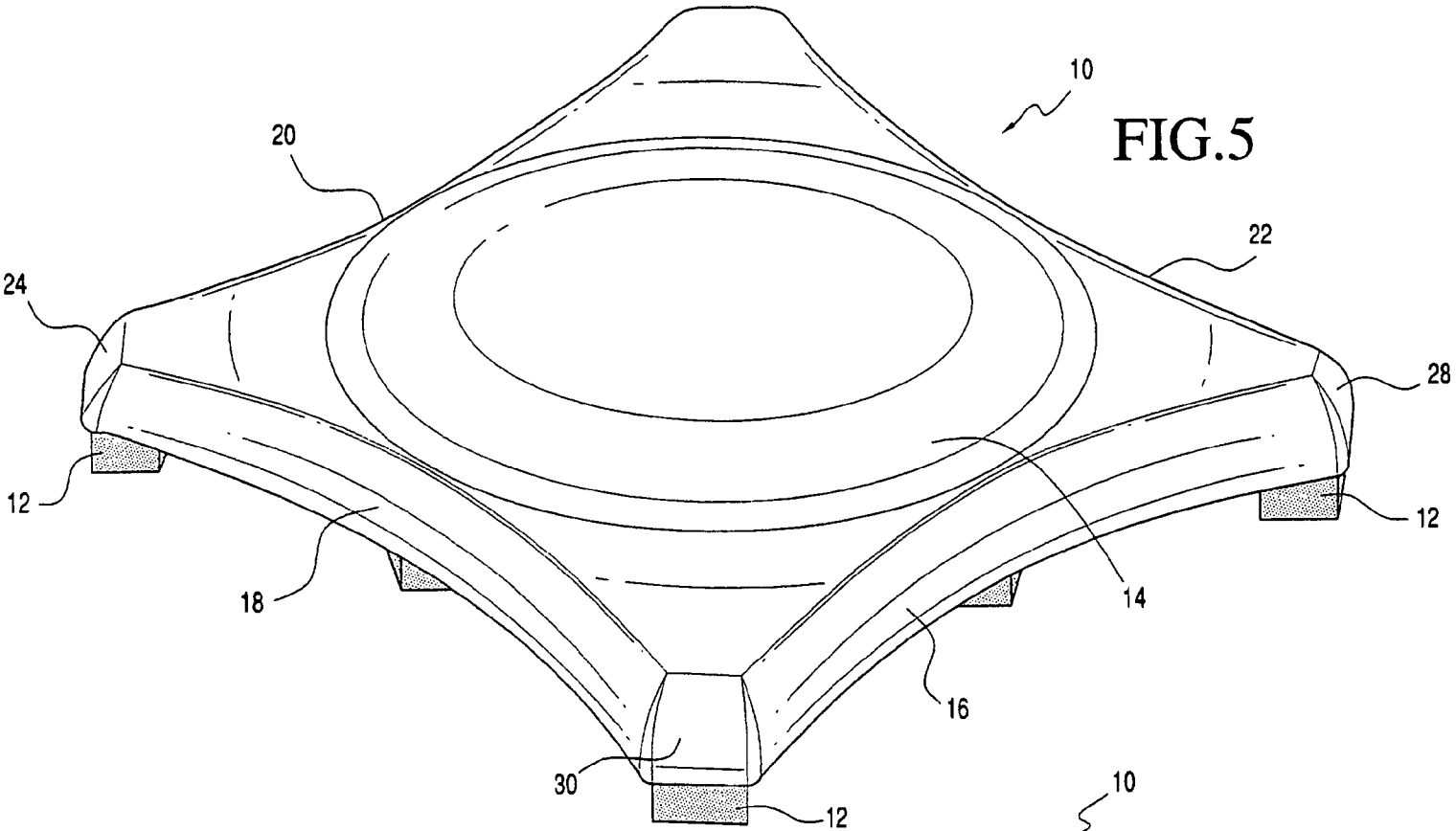
FIG. 5 is a perspective view of the exercise platform of the present invention.
Figure 4:
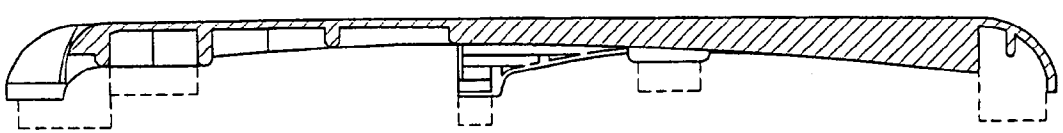
FIG. 4 is a partial cross sectional view of the exercise platform, taken along line A-A of FIG. 1, in accordance with the present invention.

In the illustrative embodiment, platform 10 has a central slightly raised circular surface 14 having a diameter of approximately 28 inches and surrounded by four concave sides 16, 18, 20, 22 of substantially equal length, each terminating in two of the four square shaped radially projecting corners to define four stability enhancing "outriggers", 24, 26, 28 and 30. Each outrigger (24, 26, 28, 30) carries at least one flexible user-replaceable resilient supporting block 12 in a pocket 32 defined on the bottom surface (as best seen in FIGS. 3, 6 and 7). The remaining four or five user-replaceable resilient supporting blocks 12 are be placed by the user in selected square pockets 32 defined by the intersecting ribs of the platform (e.g., as best seen in FIG. 3 or 7). Optionally, a supporting block is placed near the center of the platform.

The outriggers 24, 26, 28, 30 stabilize the platform 10 and prevent tipping when a user steps or places weight on one edge (e.g., side 16) when mounting or dismounting the platform. Each side, 16, 18, 20, 22, preferably defines an arch having a large radiussed segment (as best seen in the side views of FIGS. 2 and 6) and so provides a flexible but very strong supporting surface.

Platform 10 is preferably molded from plastic or structural polymer foam that is preferably blown into a mold defining an intersecting rib-reinforced, substantially planar structural surface. Each side of platform 10 has a rounded, chamfered or radiused outer peripheral edge, so the user steps on a rounded edge, rather than a sharp corner. Platform 10 may also be cast or molded from a strong polymer or strong material that dries or cures to provide a strong supporting platform; the platform may optionally be molded or cast with reinforcing fibers or rods. The resulting platform is lightweight and with the outriggers, substantially covers a rectangular area that is 32" by 32", and so is convenient to transport and stack. The Energy Blocks® (i.e., supporting blocks 12) assure that its use, even in an apartment, hotel room, or other multi-unit facility, will be quiet and not likely to disturb others.

Platform 10 can be used for jogging in place on the platform surface 14, jumping in place on the platform surface, stepping or hopping onto and off of the platform surface, performing a choreographic routine on the platform surface or performing any other physical or exercise related activity that is enhanced by the "stiff trampoline" like cushioning provided by platform 10.

Figure 2:
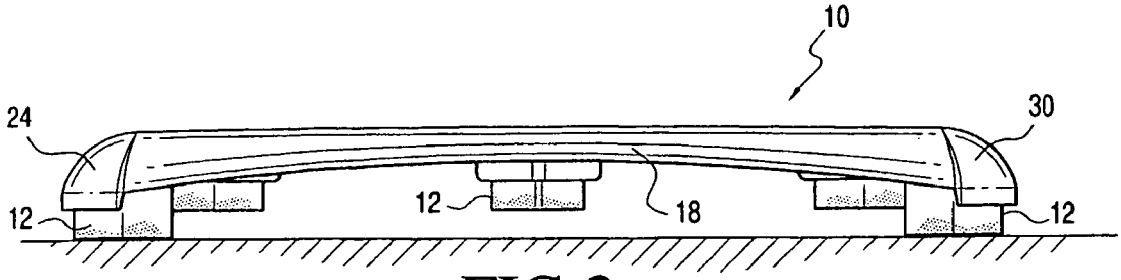
FIG. 2 is a side view, in elevation, of the exercise platform of FIG. 1, in accordance with the present invention.

Platform 10 provides an exercise platform assembly having a stiffness or rebounding action that is easily and conveniently varied by the user. This is achieved in the present invention by providing an adjustable support assembly under exercise platform 10 so that the exercise platform is able to flex as a force is applied thereto. The adjustable support assembly comprises a first level support and a second level support, both of which are removably inserted under the exercise platform 10. The first level support comprises an array of four support blocks 12 placed under the outriggers at four corners of the platform, resting in continuous contact with the ground, as best seen in FIGS. 2 and 6. The second support structure is inserted under exercise platform 10 and, when not bearing a user's weight, is spaced above the ground also best seen in FIGS. 2 and 6. The support blocks in the first and second support levels are dimensioned such that an increasing number of the support blocks 12 support exercise platform 10 as the amount of weight borne by exercise platform 10 increases. As the amount of support structure supporting the exercise platform is varied, the rebounding action of the exercise platform is likewise varied. As shown in FIGS. 2 and 6, when platform 10 bears no weight, four support blocks in the outriggers 24, 26, 28, 30 are in contact with the ground, but the four other support blocks carried in the pockets proximate the sides 16, 18, 20, 22 are not in contact with the ground, and so the exercise platform assembly of the present invention provides two progressive levels of resistance and stiffness.

Each platform 10 is optionally part of a kit including two complete sets of user interchangeable resilient blocks 12. The first set of resilient blocks 12 comprises a plurality (e.g., eight or nine) blocks of relatively stiffer quality or higher durometer. The second set of resilient blocks 12 comprises a plurality (e.g., eight or nine) blocks of relatively softer quality or lower durometer, where a plurality (e.g., eight or nine) pockets 34 of platform 10 are dimensioned to receive and hold the user replaceable blocks 12. Support blocks 12 may be retained in the corresponding platform receiving pockets 32 by a friction fit or may be fastened in place using an adhesive. The resilient foam blocks 12 and platform material effectively absorb and dampen the sound of footfalls when exercising.

The method for adjusting the rebound stiffness of exercise platform 10 comprises the method steps of providing a substantially planar platform body having an upper surface opposite a lower surface carrying a spaced array of pockets 32 adapted to receive flexible user-replaceable resilient supporting blocks 12, and providing a kit having first set of flexible user-replaceable resilient supporting blocks having a first selected stiffness or durometer, and providing a first selected rebound stiffness when compressed by a user. The kit also includes a second set of flexible user-replaceable resilient supporting blocks 12 having a second selected stiffness or durometer, and providing a second selected rebound stiffness when compressed by a user, where the second rebound stiffness is noticeably different than the first set's rebound stiffness. Next, the user selects from between the first set of supporting blocks and the second set of supporting blocks. The user then installs the selected set of supporting blocks 12 in the platform pockets 32 to provide an exercise platform 10 having a selected rebound stiffness.

It will be appreciated that the present invention, broadly speaking, makes available a portable resilient action exercise platform 10, comprising a substantially planar platform body fabricated from molded polymer, where the platform body has four corners or outriggers 24, 26, 28, 30 with four concave sides 16, 18, 20, 22 connecting the corners to provide four spaced outrigger support points. The platform body has an upper surface opposite a lower surface and the lower surface carries a spaced array of four pockets 32 adapted to receive flexible user-replaceable resilient supporting blocks 12 next to or proximate the platform body corners. Preferably, the platform assembly includes at least a first set of flexible user-replaceable resilient supporting blocks 12 having a first selected stiffness or durometer, and providing a first selected rebound stiffness when compressed by a user.

Having described preferred embodiments of a new and improved platform and method, it is believed that other modifications, variations and changes will be suggested to those skilled in the art in view of the teachings set forth herein. It is therefore to be understood that all such variations, modifications and changes are believed to fall within the scope of the present invention, as set forth in the claims.

What is claimed is:

1. A portable resilient action exercise platform, comprising:

a substantially planar platform body fabricated from molded polymer, said platform body having four stability enhancing radially projecting outrigger corners with four concave sides connecting said corners to provide four spaced supports;

said platform body having an upper surface opposite a lower surface; wherein said upper surface is bounded by rounded side surfaces said platform body lower surface carrying a spaced array of four corner pockets adapted to receive flexible user-replaceable resilient supporting blocks proximate said platform body corners; and a first set of flexible user-replaceable resilient supporting blocks having a first selected stiffness or durometer, and providing a first selected rebound stiffness when compressed by a user.

2. The portable exercise platform of claim 1, wherein said platform body lower surface carries a spaced array of four side pockets adapted to receive flexible user-replaceable resilient supporting blocks proximate said platform body concave sides.

3. The portable exercise platform of claim 2, wherein said platform body corner pockets are positioned at a first level.

4. The portable exercise platform of claim 3, wherein said platform body side pockets are positioned at a second level above said first level.

5. The portable exercise platform of claim 2, wherein said platform body side pockets and corner pockets are adapted to removably carry said supporting blocks in a friction fit.

6. The portable exercise platform of claim 2, further comprising: a second set of flexible user-replaceable resilient supporting blocks having a second selected stiffness or durometer, and providing a second selected rebound stiffness when compressed by a user; said second rebound stiffness being noticeably different than said first set's rebound stiffness.

7. The portable exercise platform of claim 6, wherein said platform body lower surface carries a spaced array of four side pockets adapted to receive flexible user-replaceable resilient supporting blocks proximate said platform body concave sides.

8. The portable platform of claim 7, wherein said platform body corner pockets are positioned at a first level.

9. The portable platform of claim 8, wherein said platform body side pockets are positioned at a second level above said first level.

10. The portable platform of claim 9, wherein said platform body corner pockets and side pockets are adapted to receive a combined assortment of supporting blocks from said first set of flexible user-replaceable resilient supporting blocks and said second set of flexible user-replaceable resilient supporting blocks.

11. The portable exercise platform of claim 1, wherein said planar platform body has a central slightly raised circular surface.

12. The portable exercise platform of claim 1, wherein said concave sides are of substantially equal length.

13. The portable exercise platform of claim 1, further comprising a center pocket carried on the lower surface of the platform adapted to receive a flexible user-replaceable resilient supporting block proximate the center of the exercise platform.

14. The portable exercise platform of claim 1, wherein said planar platform body in an intersecting rib-reinforced, substantially planar structural surface.

15. The portable exercise platform of claim 1, wherein said planar platform body is molded or cast with reinforcing fibers or rods.

16. A method for adjusting the rebound stiffness of an exercise platform, comprising the method steps of:

(a) providing a substantially planar platform body having an upper surface opposite a lower surface carrying a spaced array of pockets adapted to receive flexible user-replaceable resilient supporting blocks and (b) providing a kit having a first set of flexible user-replaceable resilient supporting blocks having a first selected stiffness or durometer, and providing a first selected rebound stiffness when compressed by a user;

(c) providing, in said kit, a second set of flexible user-replaceable resilient supporting blocks having a second selected stiffness or durometer, and providing a second selected rebound stiffness when compressed by a user wherein said second rebound stiffness is noticeably different than said first set's rebound stiffness;

(d) selecting from said first set of supporting blocks and said second set of supporting blocks; and (e) installing the selected set of supporting blocks in said platform pockets to provide an exercise platform having a selected rebound stiffness.

17. The method for adjusting the rebound stiffness of an exercise platform of claim 16, further comprising:

(f) removing the selected set of supporting blocks in said platform pockets, and (g) installing a second selected set of supporting blocks in said platform pockets to provide an exercise platform having a second selected rebound stiffness.

18. A portable resilient action exercise platform and adjustment kit, comprising:

a substantially planar platform body fabricated from molded polymer, said platform body having four radially arrayed stability enhancing radially projecting corners with four concave, rounded sides connecting said corners to provide four spaced supports;

said platform body having an upper surface opposite a lower surface;

said platform body lower surface carrying a spaced array of four corner pockets adapted to receive flexible user-replaceable resilient supporting blocks proximate said platform body corners;

a first set of flexible user-replaceable resilient supporting blocks having a first selected stiffness or durometer, and providing a first selected rebound stiffness when compressed by a user;

wherein said platform body lower surface carries a spaced array of four side pockets adapted to receive flexible user-replaceable resilient supporting blocks proximate said platform body concave sides.

19. The portable exercise platform and adjustment kit of claim 18, wherein said platform body corner pockets are positioned at a first level;

wherein said platform body side pockets are positioned at a second level above said first level; and wherein said platform body side pockets and corner pockets are adapted to removably carry said supporting blocks in a friction fit.

20. The portable exercise platform and adjustment kit of claim 19, further comprising:

a second set of flexible user-replaceable resilient supporting blocks having a second selected stiffness or durometer, and providing a second selected rebound stiffness when compressed by a user; said second rebound stiffness being noticeably different than said first set's rebound stiffness.

* * * * *